United States Patent [19]

Hambrick

[11] 4,398,409

[45] Aug. 16, 1983

[54] FRICTION SHOCK ASSEMBLY FOR A FORGING HAMMER

[75] Inventor: Robert D. Hambrick, Havana, Ill.

[73] Assignee: National-Standard Company, Niles, Mich.

[21] Appl. No.: 237,497

[22] Filed: Feb. 23, 1981

[51] Int. Cl.[3] ..... B21J 9/12

[52] U.S. Cl. ..... 72/453.01; 72/441; 188/130

[58] Field of Search ..... 72/453.01, 453.18, 435, 72/436, 437, 438, 441, 444; 188/130, 83, 71.5, 72.7, 72.8; 91/337, 338, 322

[56] References Cited

U.S. PATENT DOCUMENTS

| | | | |
|---|---|---|---|
| 605,544 | 6/1898 | Good | 72/437 |
| 607,579 | 7/1898 | Wieland | 72/444 |
| 1,531,489 | 3/1925 | Macready | 72/435 |
| 1,709,359 | 4/1929 | Martin | 188/130 |
| 1,822,824 | 9/1931 | Roumens | 188/130 |
| 3,028,619 | 4/1962 | Schlage | 188/130 |
| 3,142,206 | 7/1964 | Hague | 72/453.18 |
| 3,173,285 | 3/1965 | Terhune | 72/453.18 |

*Primary Examiner*—Gene Crosby

*Attorney, Agent, or Firm*—Emrich, Lee, Brown & Hill

[57] ABSTRACT

A friction shock absorber comprised of a plurality of mating friction surfaces in constant contact together is incorporated on an oscillating member of the valve shifting mechanism of a forging hammer for preventing the valve from bouncing away from its intended position after it has been shifted by the motion of the forging hammer ram.

10 Claims, 3 Drawing Figures

FRICTION SHOCK ASSEMBLY FOR A FORGING HAMMER

BACKGROUND OF THE INVENTION

It is well known in the art that a forging hammer having a pneumatic cylinder for powering the ram to accelerate the ram to high velocities before the object to be forged is struck and engaged by the ram. It is also common practice in the art to mechanically link a valve shifting mechanism, which reverses the direction of the ram or hammer to the motion of the ram itself. Furthermore, in addition to having the direction of its motion reversed, it is common for the ram to rapidly bounce back. To maintain the valve mechanism in its intended position, hydraulic shock absorbers of the automotive type have been employed in the valve shifting mechanism. Unfortunately, the heat and abrasive particles in a forging atmosphere have a deleterious effect to such hydraulic shock absorbers. As a result, they have an exceedingly variable life, sometimes only a matter of days or weeks.

SUMMARY OF THE INVENTION

The primary object of the present invention is to provide a rugged friction type shock absorber which can withstand the heat and abrasive particles associated with a forging atmosphere and maintain the shifting valve in its intended position once it has been moved as the result of the motion of the ram of the forging hammer.

The present invention incorporates a friction type shock absorber assembly on an oscillating member of the valve shifting mechanism and includes friction elements on the surfaces which are constantly in contact with each other thus minimizing the inclusion of foreign particles which could rapidly deteriorate the assembly.

The present invention further incorporates spring means which bias and hold the surfaces of the friction elements together under the desired pressure. Adjustment screws or means are provided to maintain the desired pressure as the friction surfaces eventually wear to the point where adjustment is required.

DETAILED DESCRIPTION OF THE INVENTION

Figure 1:
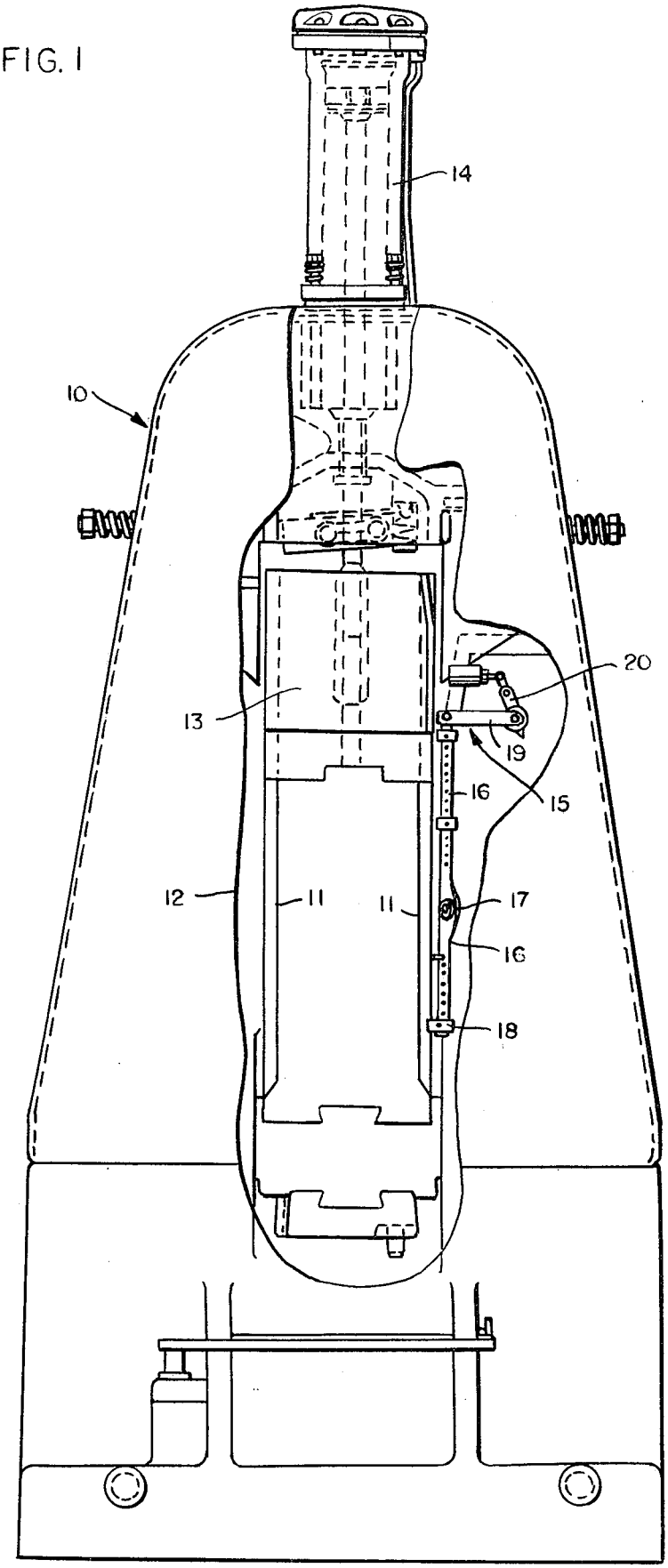
FIG. 1 is an elevation view of the front of a forging hammer showing the elements essential to the present invention.

FIG. 1 shows the slide portion 11 of the frame 12 of a forging hammer 10. As it is known in the art, a ram 13 is guided by the slide portion 11 as it is moved up and down by a cylinder 14.

Also shown in FIG. 1 is a valve shifting mechanism 15 comprised of a rocker arm 16 which pivots about stud 17 and has on the lower end a projection member 18 which contacts ram 13 at the lower end of its path of travel.

Figure 2:
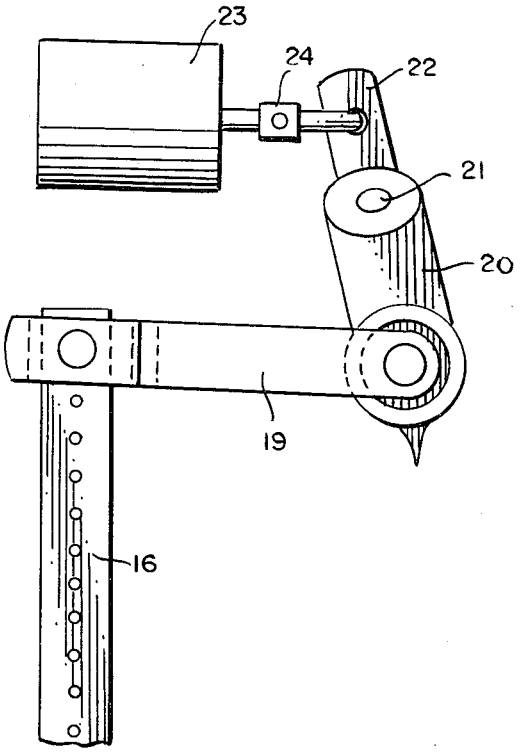
FIG. 2 is a side elevational view showing the oscillating member along with the shifting valve and the linkage to it, and a portion of the linkage associate with the motion of the ram in accordance with the present invention.

The upper end of rocker arm 16 is pivotally connected to linkage 19 as shown in FIG. 2. The opposite end of linkage 19 is pivotally attached to an arm element 20 which is affixed to an oscillating shaft 21 is a second arm member 22 which is linked to a shifting valve assembly 23 by linkage element.

Figure 3:
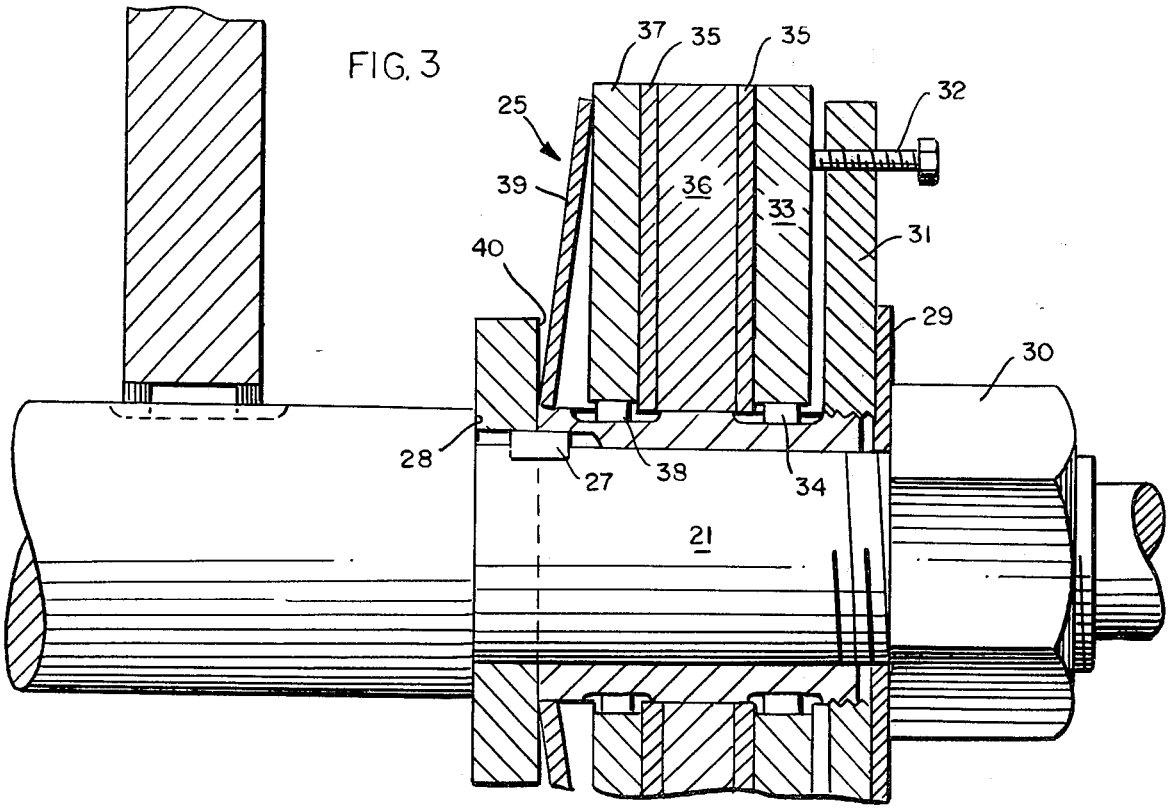
FIG. 3 is a sectional view of a portion of the oscillating member and the elements of the friction device in accordance with the present invention.

Referring now to FIG. 3, the friction shock assembly 25 is shown sectionally on the oscillating shaft 21. The assembly includes a hub member 26 keyed to the shaft 21 by key 27 and held against a shaft shoulder 28 by a washer 29 and shaft nut 30. Washer 29 is large enough in diameter to retain adjusting ring 31 on the hub member 26. Adjusting means or screws 32 press against a first splined disc means 33 which is free to slide axially on hub member 26 but is retained rotationally by key 34 to hub member 26. A pair of friction discs 35 are on either side of center plate member 36 and, all elements are free axially and rotationally on hub member 26. Center plate 36 has wing extensions (not shown) which extend radially outward and contact hammer frame 12 thereby preventing any rotational movement of center plate 36 with respect to frame 12. A second splined disc 37 is provided and is free to slide axially on hub 26 but which is retained rotationally by key 38 to hub 26. Lastly, a spring 39 on one end abuts second splined disc 37 and on the other end abuts shoulder 40 of hub 26. The spring 39 biases the assembly together to prevent abrasive particles from penetrating the assembly.

As can be seen in FIG. 3, rotation of oscillating shaft 21 is dampened by friction shock assembly 25 and in turn shifting valve 23 is prevented from bouncing away from its intended position once it is forced there by valve shifting mechanism 15. The materials of the friction shock assembly 25 are such that they readily withstand the heat of the forging hammer and, because splined discs 33, 37, friction discs 35 and center plate 36 are constantly in contact with one another by spring 39, foreign abrasive particles do not penetrate the assembly 25. Additionally, after months of use it is only necessary to move in adjusting means or screws 32 slightly to adjust for wear, if necessary.

It is readily apparent that the present invention provides a rugged friction type shock absorber assembly which can withstand the heat and particles associated with a forging atmosphere and effectively maintains the shifting valve assembly in its intended position. Further, the present invention is not subject to sudden catastrophic failure as are the hydraulic shock absorbers used previously for this purpose. The useful life of the friction type shock absorber assembly is many times that of the hydraulic type in this application, with excellent performance as well.

I claim:

1. A friction shock absorber assembly for use in a forging hammer having a pneumatic powered ram engageable with a shifting valve mechanism having an oscillating rotary shaft for reversing the direction of the ram, the improvement including a friction shock absorber assembly comprised of a plurality of friction members having mating friction surfaces adapted to be mounted and in contact with one another on the oscillating shaft, and wherein the friction members of the friction shock absorber assembly are free of enclosure and maintain a shape under working pressures without the need for an enclosure to prevent distortion of the friction material of said friction members.

2. The friction shock absorber assembly in accordance with claim 1 wherein at least one of said plurality of mating friction surfaces comprises a disc.

3. The friction shock absorber assembly in accordance with claim 1 further including adjustment means for drawing said plurality of mating friction surfaces together to thereby exclude foreign particles from the absorber assembly.

4. A friction shock absorber on an oscillating rotary member of a valve shifting mechanism of a forging hammer for preventing the valve portion of the shifting mechanism from movement from its intended position after it has been shifted by the motion of the forging hammer ram wherein said friction shock absorber includes a plurality of friction members having mating friction surfaces in contact with each other thereby excluding foreign particles from entering between said mating friction surfaces, and wherein said friction members of said friction shock absorber are free of enclosure and maintain a shape under working pressures without the need for an enclosure to prevent distortion of the friction material of said friction members.

5. The friction shock absorber in accordance with claim 4 wherein at least one of said plurality of mating friction surfaces comprises a disc.

6. The friction shock absorber in accordance with claim 4 wherein said plurality of said mating friction surfaces are urged together by a spring.

7. The friction shock absorber in accordance with claim 4 further including adjustment means for drawing said plurality of said mating friction surfaces together.

8. A friction shock absorber assembly for use in a forging hammer having a pneumatic powered ram engageable with a shifting valve mechanism having an oscillating shaft for reversing the direction of the ram, the improvement including a friction shock absorber assembly comprised of a plurality of friction members having mating friction surfaces mounted on the shaft by a shaft and urged together in contact with one another on the oscillating shaft by a spring.

9. A friction shock absorber assembly for use in a forging hammer having a pneumatic powered ram engageable with a shifting valve mechanism having an oscillating shaft for reversing the direction of the ram, the improvement including a friction shock absorber assembly comprised of a plurality of friction members having mating friction surfaces comprised of at least an adjusting ring, first and second splined disc members and a center plate member mounted on the shaft by a shaft and urged together in contact with one another on the oscillating shaft by a spring.

10. A friction shock absorber assembly for use in a forging hammer having a pneumatic powered ram engageable with a shifting valve mechanism having an oscillating shaft for reversing the direction of the ram, the improvement including a friction shock absorber assembly comprised of a plurality of friction members having mating friction surfaces comprised of at least an adjusting ring, first and second splined disc members, center plate member and friction discs mounted adjacent to said center plate member mounted on the shaft by a shaft and urged together in contact with one another on the oscillating shaft by a spring.

* * * * *